US005433348A

United States Patent [19]

Deering et al.

[11] Patent Number: 5,433,348

[45] Date of Patent: Jul. 18, 1995

[54] MODULAR DISPENSING TOWER

[75] Inventors: Robert S. Deering; Samuel Durham; Alfred A. Schroeder, all of San Antonio, Tex.

[73] Assignee: Lancer Corporation, San Antonio, Tex.

[21] Appl. No.: 178,070

[22] Filed: Jan. 6, 1994

Related U.S. Application Data

[63] Continuation-in-part of Ser. No. 4,529, Jan. 14, 1993, Pat. No. 5,333,759.

[51] Int. Cl.[6] ..... B67D 5/56

[52] U.S. Cl. ..... 222/129.1; 222/146.6; 222/424

[58] Field of Search ..... 222/129.1–129.4, 222/146.6, 424

[56] References Cited

U.S. PATENT DOCUMENTS

| | | | |
|---|---|---|---|
| 4,592,490 | 6/1986 | McMichael | 222/146.6 X |
| 4,615,466 | 10/1986 | Credle, Jr. | 222/146.6 X |
| 4,913,183 | 4/1990 | Vogel et al. | 222/129.1 X |
| 5,190,188 | 3/1993 | Credle, Jr. | 222/146.6 X |
| 5,228,312 | 7/1993 | Williams | 222/146.6 X |
| 5,285,815 | 2/1994 | Henry et al. | 222/129.1 X |
| 5,333,759 | 8/1994 | Deering | 222/146.6 X |
| 5,335,819 | 8/1994 | Martin | 222/146.6 |

*Primary Examiner*—Karen B. Merritt
*Assistant Examiner*—Kenneth R. DeRosa
*Attorney, Agent, or Firm*—Donald R. Comuzzi; Christopher L. Makay

[57] ABSTRACT

A beverage dispensing apparatus includes a modular dispensing tower which may be positioned remote from both the product and the cooling unit or, alternatively, may be mounted onto the cooling unit housing using quick connect couplings. When positioned remote from the cooling unit, the modular dispensing tower connects to the cooling unit through an insulated trunk line which allows positioning of the modular dispensing tower up to twenty five feet away from the cooling unit. Additionally, the modular dispensing tower comprises an insulated manifold which operates to significantly decrease the temperature of the dispensed "casual" drink. The manifold houses a plurality of product conduits which are positioned against a carbonated water conduit which works in a recirculation system to greatly reduce the temperature of the dispensed "casual" drink. Furthermore, the modular dispensing tower may reside on the countertop or may be mounted onto the edge of the countertop in order to save countertop space. Also to save countertop space, the cooling unit and product source are configured to fit underneath a counter with only the modular dispensing tower residing on the counter or mounted onto a counter edge. The beverage dispensing apparatus, therefore, greatly saves countertop space while providing a modular dispensing tower configuration which greatly reduces the temperature of the dispensed "casual" drink.

8 Claims, 6 Drawing Sheets

MODULAR DISPENSING TOWER

CROSS REFERENCE TO RELATED APPLICATIONS

The application is a continuation in-part of application Ser. No. 08/004,529 filed on Jan. 14, 1993, now U.S. Pat. No. 5,333,759, and having common ownership.

BACKGROUND OF THE INVENTION

The present invention relates to an apparatus for dispensing drinks and, more particularly, but not by way of limitation, to an apparatus for dispensing drinks which is remote from its cooling unit or, alternatively, mounts onto the cooling unit housing and connects to a beverage product source using quick connect couplings.

A major concern in the drink dispensing industry is the availability of countertop space. Available countertop space is of particular concern to small convenience stores, cafeterias, concession stands, fast food service lines, or like businesses because rents which are normally determined based upon total square footage are expensive. Thus, available countertop space becomes an extremely valuable commodity to those in the above businesses. That is, wasted countertop space can be directly equated to higher overhead for a business.

Conventional drink dispensers are typically single units comprising a housing that contains a carbonator coupled to a cooling apparatus (i.e., either a refrigeration unit including product lines or a cold plate), which in turn is coupled to drink dispensing valves connected to the outside of the housing. Additionally, the carbonator is connected to a water source and $CO_2$ source while the cooling apparatus is coupled to a product source.

The major disadvantage of such units is that they are bulky and occupy large amounts of countertop space. If the units were smaller or placed in a different location, available countertop space could be increased, thereby, allowing for more effective countertop utilization. The drink dispensing industry, therefore, requires a drink dispensing unit which will fit under a counter with only a minimum of dispensing equipment occupying countertop space.

Another concern in the drink dispensing industry is the temperature at which drink dispensing systems dispense the "casual" drink (i.e., the temperature of the drink dispensed during periods of low use or the temperature of the drink dispensed after no drink has been dispensed for an extended period). It is desirable to dispense drinks below a temperature of 40° F. A drink dispensed above 40° F. will foam excessively which makes the dispensing of a drink difficult if not impossible. Unfortunately, conventional drink dispensers typically are unable to dispense the "casual" drink at a temperature below 40° F. and normally dispense the "casual" drink with an average temperature of 42° F. Such a dispensing temperature for the "casual" drink is unacceptable in the drink dispensing industry, and therefore, there is a large demand in that industry for a drink dispensing system which can deliver a colder "casual" drink.

The present invention, accordingly, answers industry demand and overcomes the above problems by dispensing the "casual" drink below 40° F. while occupying minimal countertop space because except for a modular dispensing tower, the entire unit can be configured to reside underneath a counter.

SUMMARY OF THE INVENTION

The present invention is a beverage dispensing apparatus which in a first embodiment functions as an under the counter beverage dispensing apparatus having a modular dispensing tower which is remote from the cooling unit, thus, saving significant countertop space. Alternatively, in a second embodiment, the modular dispensing tower can be configured to mount onto the cooling unit housing and connect to the product source and carbonated water source utilizing quick connect couplings. Furthermore, the design of the modular dispensing tower is such that the beverage dispenser of the present invention will dispense the "casual" drink at a temperature below 40° F. The beverage dispensing apparatus of the present invention, therefore, ensures that the "casual" drink will be dispensed at a temperature below 40° F., and, when the beverage dispensing apparatus of the present invention is configured for under the counter operation, it saves significant countertop space.

The beverage dispensing apparatus of the present invention comprises a cooling unit housing which includes a cooling chamber and a cooling chamber cover. The cooling chamber-cooling chamber cover combination function together to house the cooling unit and a recirculation unit and, further, to house a water line, product lines, and a carbonator. The cooling unit comprises a refrigeration unit which forms an ice bank from a cooling fluid, typically water, contained within the cooling chamber. The ice bank provides the cooling required by the water lines, product lines, and the recirculation line of the recirculation unit. The product lines communicate at their inlets with a product source and at their outlets with dispensing valves mounted on the modular dispensing tower. The water line connects at its inlet to a water source and at its outlet to the carbonator. The carbonator further connects to a $CO_2$ source and inlets both water and $CO_2$ to form carbonated water which is dispensed, along with the product, from the dispensing valves mounted on the modular dispensing tower, thus, forming the carbonated beverage product.

Alternatively, the cooling unit and recirculation unit may comprise a cold plate which resides in the bottom of the cooling chamber and includes product, water, and carbonated water lines. The product lines communicate at their inlets with a product source and at their outlets with dispensing valves mounted on the modular dispensing tower. The water line connects at its inlet to a water source and at its outlet to the carbonator. The carbonator further connects to a $CO_2$ source and inlets both water and $CO_2$ to form carbonated water. The outlet from the carbonator connects to the carbonated water line of the cold plate which supplies both the product and carbonated water to the dispensing valves mounted on the modular dispensing tower, thus, forming the carbonated beverage product.

The recirculation unit comprises a recirculation coil positioned within the cooling chamber and connected at its outlet using a tee connection to the carbonated water line which in turn connects to the dispensing valves mounted on the modular dispensing tower. The inlet of the recirculation coil also connects to the modular dispensing tower via a carbonated water return line. Thus, the carbonated water continually circulates from the modular dispensing tower through the recirculation coil and back to the modular dispensing tower when the dispensing valves are not actuated. The recirculation unit further comprises a pump interposed to the modular dispensing tower and the recirculation coil to continually pump the carbonated water through the recirculation coil when the dispensing valves are not actuated. Additionally, when the dispensing valves are actuated, carbonated water from the carbonator will be introduced into the modular dispensing tower so that sufficient carbonated water to form a dispensed carbonated beverage will always be present.

In the under the counter configuration, the modular dispensing tower is remote from the cooling unit and may be positioned up to twenty five feet away. Connection between the modular dispensing tower and the cooling unit, namely the carbonated water/recirculation line, the recirculation return line, and the product lines, is effected through a trunk line which removably connects at one end to the above lines and at its opposite end to a manifold housed within the modular dispensing tower. In turn, the manifold connects to the dispensing valves mounted on the modular dispensing tower. The manifold comprises a plurality of conduits encased in insulation to prevent heat exchange between both the carbonated water and product and the environment. The trunk line itself is insulated to further help prevent the heat exchange between both the carbonated water and product and the environment.

For the configuration of the second embodiment, the modular dispensing tower mounts directly onto the cooling unit housing. Connection between the modular dispensing tower and the cooling unit, namely the carbonated water/recirculation line, the recirculation return line, and the product lines, is effected through conduits which reside within the cooling unit housing. Each conduit connects at its inlet to one of the carbonated water/recirculation line, the recirculation return line, and the product lines. The outlets of the conduits each terminate in one member of a quick connect coupling. Additionally, the conduits are encapsulated in insulation to limit the heat transfer between the cooled product and carbonated water delivered to the modular dispensing tower from the cooling unit.

In the second embodiment, the modular dispensing tower includes a similar insulating manifold which encases conduits to prevent heat exchange between the environment and both the carbonated water and product circulated through the conduits. However, each conduit inlet terminates at a quick connect coupling that is the opposite from the quick connect couplings at the outlets of each of the cooling unit conduits. Additionally, the conduits connect at their outlets to the dispensing valves mounted on the modular dispensing tower.

Thus, to connect the modular dispensing tower to the cooling unit housing, the quick connect couplings of the modular dispensing tower conduits and the cooling unit conduits are engaged to provide a junction which allows product and carbonated water to flow from the cooling unit to the dispensing couplings mounted on the modular dispensing tower. Accordingly, with the quick connect valves engaged, the modular dispensing tower resides on the cooling unit housing to form the beverage dispensing apparatus according to the second embodiment of the present invention.

The beverage dispensing apparatus of the present invention dispenses the "casual" drink below 40° F. as a result of the recirculation of the carbonated water and the unique configuration of the modular dispensing tower insulated manifold. That is, by recirculating the carbonated water from the modular dispensing tower back to the cooling unit during periods of non-use, the carbonated water remains at the lowest temperature possible (i.e., approximately 34° F.). Accordingly, a dispensed drink will have extremely cold carbonated water.

Furthermore, the manifold is configured such that the product conduits physically contact the carbonated water conduit. Thus, because the carbonated water conduit is significantly cooler than the product conduits, heat exchange between them takes place. Although the carbonated water accumulates heat, the amount of heat gathered is insufficient to raise the temperature of the carbonated water above 40° F. while the heat lost by the product lines is sufficient to lower the product temperature below 40° F. The beverage dispensing apparatus of the present invention, therefore, dispenses the "casual" drink at or below 38° F.

In addition, the design of the modular dispensing tower to be positionable remote from the cooling unit saves countertop space because the modular dispensing tower placed on the countertop by itself is considerably smaller than conventional beverage dispensing units which have the cooling unit mounted on the countertop. Furthermore, the modular dispensing tower includes a mount which permits it be fastened to the edge of a countertop, thereby, taking up even less space than conventional beverage dispensing units.

It is, therefore, an object of the present invention to provide a beverage dispensing apparatus with a cooling unit capable of fluidly communicating with a remote modular dispensing tower.

It is another object of the present invention to provide a beverage dispensing apparatus which is capable of dispensing a "casual" drink at a temperature below 40° F.

It is a further object of the present invention to provide a beverage dispensing apparatus which continually circulates carbonated water through the cooling unit and modular dispensing tower in order to reduce the temperature of the dispensed "casual" drink.

It is still another object of the present invention to provide a beverage dispensing apparatus with a modular dispensing tower having an insulated manifold which reduces the heat exchange between the previously cooled product and carbonated water and the environment.

It is still a further object of the present invention to provide a beverage dispensing apparatus with a modular dispensing tower having an insulated manifold which contacts the product lines with the carbonated beverage lines having recirculated carbonated water therein in order to facilitate heat exchange therebetween.

It is even a further object of the present invention to provide a beverage dispensing apparatus with a modular dispensing tower that mounts onto a cooling unit housing and connects to the cooling unit utilizing quick connect couplings.

Still other features and advantages of the present invention will become evident to those skilled in the art in light of the following.

DETAILED DESCRIPTION OF THE PREFERRED EMBODIMENTS

Figure 1:
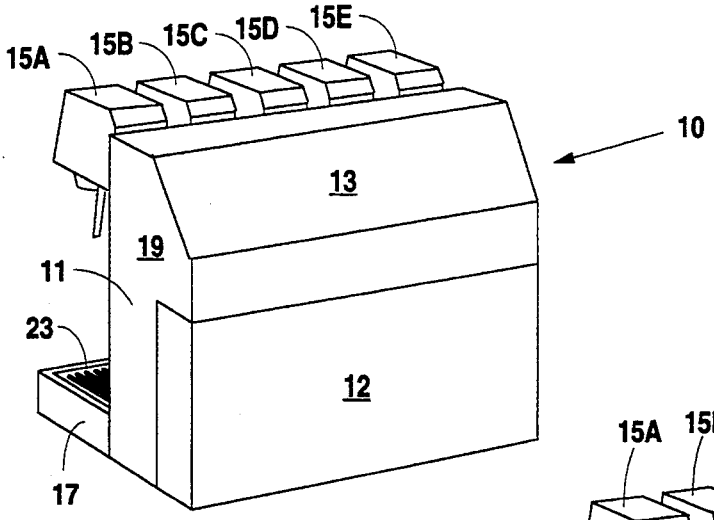
FIG. 1 is a perspective view showing the rear of the modular dispensing tower of the present invention in the configuration used when it resides on a planar surface.
Figure 2:
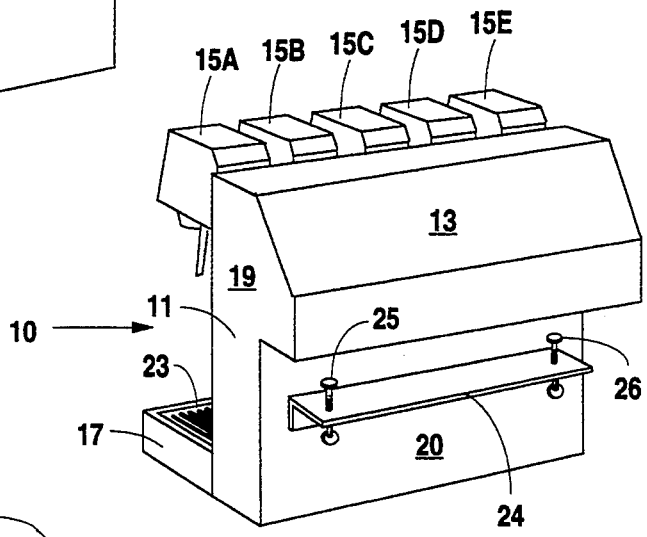
FIG. 2 is a perspective view showing the rear of the modular dispensing tower of the present invention in the configuration used when it is mounted onto the end of a planar surface.

Referring to FIGS. 1–5, the modular dispensing tower according to the first embodiment of the present invention will be described. Modular dispensing tower 10 comprises housing 11, top cover 13, manifold 14, face plate 16 (see FIGS. 6 and 7), dispensing valves 15A–E and drip tray 17. Housing 11 comprises side walls 18 and 19 which are parallel to each other and connected by wall 20. Housing 11 encloses and supports manifold 14. Manifold 14 is placed within housing 11 and secured to the housing using screws 21 and 22 (see FIG. 3). Face plate 16 is then fitted to the front of housing 11 and secured using any suitable means such as screws. Face plate 16 is provided with openings at its top (not shown) which permit the connection of the dispensing valves to the conduits housed within manifold 14 (described herein with reference to FIGS. 4 and 5). Furthermore, face plate 16 supports dispensing valves 15A–E which are mounted onto face plate 16 using any suitable means such as screws or nuts and bolts. After dispensing valves 15A–E are attached to manifold 14 and mounted onto face plate 16, top cover 13 is mounted over housing 11 using any suitable means such as screws in order to remove manifold 14 and the backs of dispensing valves 15A–E from view. Positioned below dispensing valves 15A–E and connected to the bottom of face plate 16 using any conventional means such as screws is drip tray 17 which collects spilled product and ice. Drip tray 17 is connected to a drain using a hose (not shown) to conduct the spilled product and melted ice to the drain. Additionally, positioned within drip tray 17 is cup rest 23 which provides a support for cups as they are filled from any one of dispensing valves 15A–E.

Figure 6:
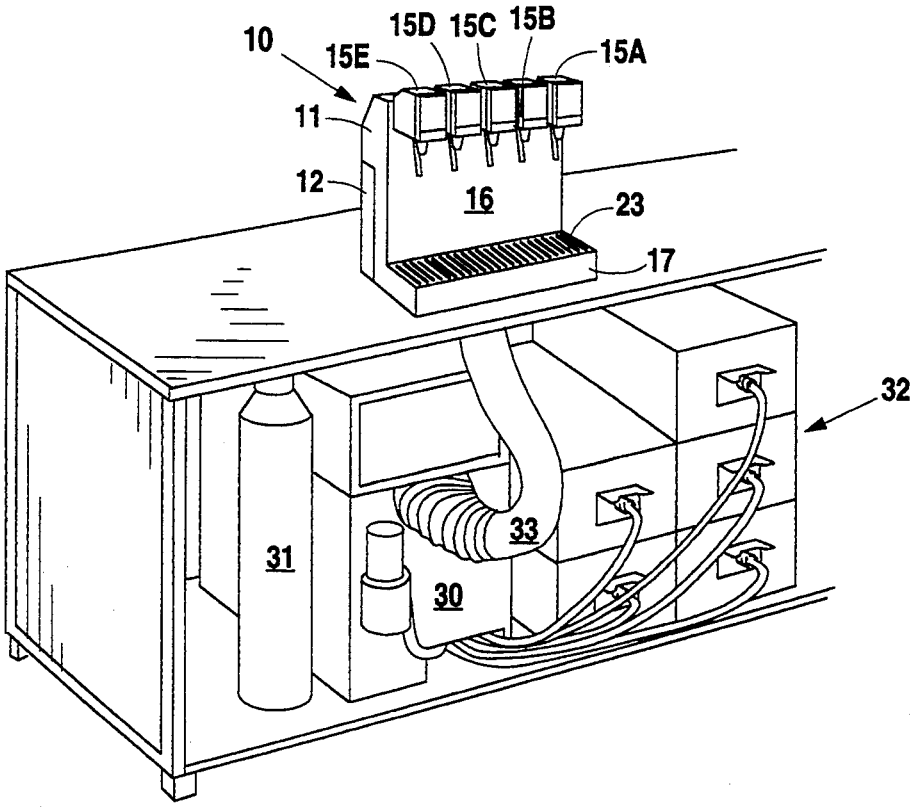
FIG. 6 is a perspective view showing the beverage dispensing apparatus of the present invention wherein the modular dispensing tower resides on top of a counter while the cooling unit, product source, and $CO_2$ source fit under the counter.
Figure 7:
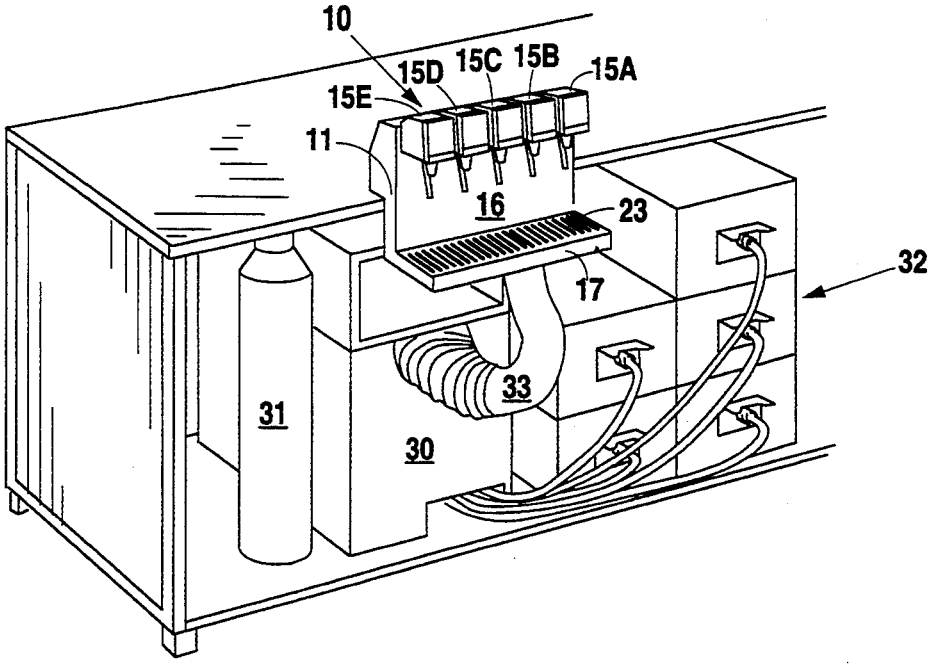
FIG. 7 is a perspective view showing the beverage dispensing apparatus of the present invention wherein the modular dispensing tower is mounted onto the front of a countertop while the cooling unit, product source, and $CO_2$ source fit below the counter.

Modular dispensing tower 10 may be mounted onto a countertop such that it resides completely on the counter (See FIG. 6) or it may be mounted onto one of the edges of the counter (See FIG. 7). To allow mounting of modular dispensing tower 10 onto the edge of a counter, the back of wall 20 is provided with bracket 24. Bracket 24 is mounted onto the back of the wall 20 using any suitable means such as screws or welding. Bracket 24 is fitted with fastening screws 25 and 26 which facilitate the mounting of modular dispensing tower 10 onto the edge of a countertop (described herein). In the event that modular dispensing tower 10 is configured to reside on top of the counter, it is provided with rear cover 12 which mounts to the back of housing 11 using any suitable means such as screws in order to cover bracket 24 and provide an aesthetically pleasing appearance.

Figure 3:
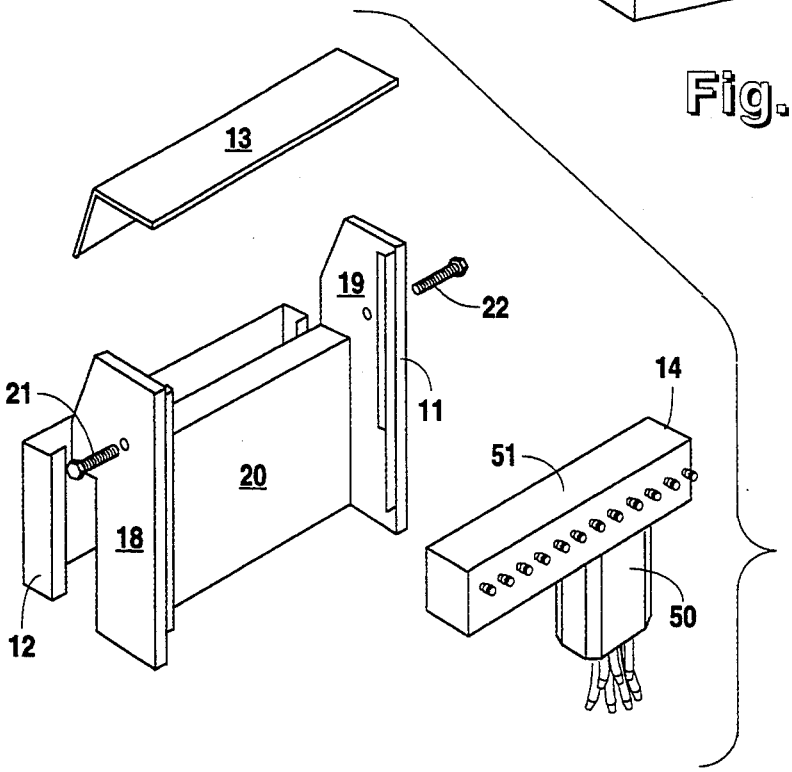
FIG. 3 is an exploded perspective view showing the front of the modular dispensing tower of the present invention.
Figure 4:
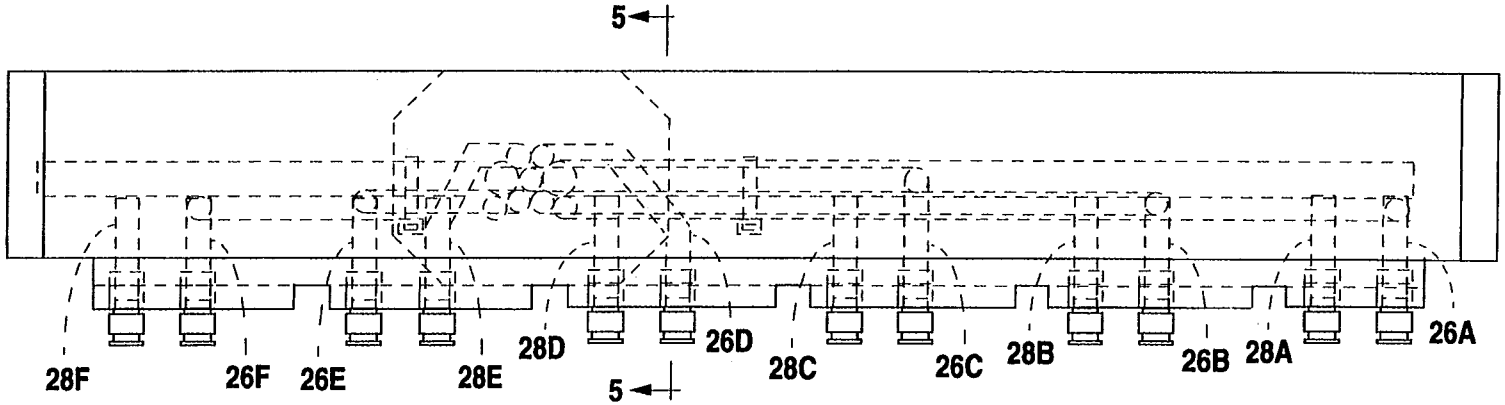
FIG. 4 is a top view of the manifold of the present invention showing the positioning of the fluid conduits within the manifold.
Figure 5:
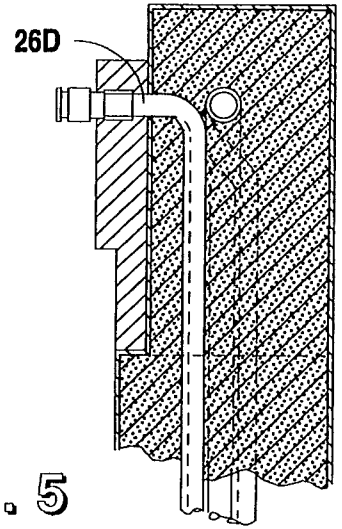
FIG. 5 is cross-sectional partial top view showing the manifold of the present invention.

Turning specifically to FIGS. 3–5, manifold 14 of the present invention will be described. Manifold 14 comprises product conduits 26A–F and carbonated water conduit 27, all of which are encapsulated in an insulating material such as foam. The inlets of product conduits 26A–F extend slightly beyond the lower portion of the insulating material and are provided with barbs which facilitate the connection of product conduits 26A–F to other product lines (described herein) which ultimately connect to a product source. Each outlet of product conduits 26A–F connects to one of dispensing valves 15A–E using any suitable means such as a threaded cap. Carbonated water conduit 27 also extends below the lower portion of the insulating material and has an inlet having a barb which facilitates connection to a carbonated water line which in turn is connected to a carbonator. Carbonated water conduit 27 delivers carbonated water to dispensing valves 15A–E through outlets 28A–F one of which is connected to each of dispensing valves 15A–E using any suitable means such as threaded caps. However, unlike product lines 26A–F, carbonated water conduit 27 does not terminate at outlets 28A–F, but instead, circles around to form a return line which also extends below the insulating material of manifold 14. The return line portion of carbonated water conduit 27 connects to the input of a recirculation coil housed within a cooling unit and permits recirculation of the carbonated water, thus, providing increased and constant cooling of the carbonated water. The inlet of carbonated water conduit 27 is not only connected to a carbonator through a carbonated water line but also to the outlet of the recirculation coil. The carbonator and the outlet of the recirculation coil are connected to the carbonated water line through a T-shaped connection. Thus, the constant recirculation of the carbonated water helps to decrease the temperature at which the "casual" drink is dispensed.

Carbonated water conduit 27 is configured within the insulating material such that it encircles product conduits 26A–F and contacts those conduits both in inlet stem portion 50 and outlet head portion 51 of the insulating foam material which encapsulates product conduits 26A–F and carbonated water conduit 27 and forms manifold 14 (see FIG. 3). The contact between product conduits 26A–F and carbonated water conduit 27 permits a heat exchange between the product carried through product conduits 26A–F and the carbonated water carried through carbonated water conduit 27 which facilitates a dispensing temperature of the carbonated beverage. That heat exchange occurs because the carbonated water is maintained at a temperature below that of the product due to its constant recirculation (approximately 34° F.). The carbonated water circulating through manifold 14 removes heat from the product and takes it back to the recirculation coil where it is removed before returning via the carbonated water line in the heat exchange which takes place in the cooling unit. Thus, as the carbonated water circulates, the continual heat exchange between the carbonated water and the product keep the product at a temperature below 40° F. while the carbonated water still remains at a temperature below 40° F. Additionally, the insulating material utilized to construct manifold 14 significantly reduces the heat exchange between both product conduits 26A–F and carbonated water conduits 27 and the atmosphere. The reduction in the loss of cooling to the atmosphere is directly reflected in a reduced dispensed drink temperature, specifically, the temperature of the "casual" drink. Thus, the beverage dispensing apparatus of the present invention while using modular dispensing tower 10 will dispense a "casual" drink at a temperature of approximately 38° F. because the recirculation of cooled carbonated water through the highly insulated manifold reduces product temperature, thus, allowing drinks to be dispensed at a temperature significantly lower than that of conventional drink dispensers.

In the first embodiment, product conduits 26A–F and carbonated water conduit 27 may be constructed of any conventional metal or copper tubing, however, one of ordinary skill in the art will readily recognize that such tubing could be encased within aluminum or the conduits themselves comprised of aluminum tubing in order to enhance the heat exchange between the product conduits and the carbonated water conduit.

Referring to FIGS. 6 and 7, the configuration and operation of the beverage dispensing apparatus according to the preferred embodiment of the present invention will be described. Because modular dispensing tower 10 will function to dispense drinks although connected remotely from the remaining beverage dispensing apparatus, that apparatus may be placed in an out of the way location such as underneath a counter. The remaining beverage dispensing apparatus comprises cooling unit 30, $CO_2$ source 31, product source 32, and trunk line 33. Cooling unit 30 comprises a water bath used to cool water before it is carbonated, the carbonated water itself, and the product. The water bath comprises a cooling chamber filled with a cooling fluid, typically water, with a refrigeration unit positioned over the cooling chamber such that its evaporator coils are immersed in the water, thereby, facilitating the forming of an ice bank within the cooling chamber. Residing in the center of the cooling chamber and, thus, inside the ice bank is a water line which is connected at its inlet to a water source and its outlet to a carbonator which resides in the front portion of the cooling chamber. Also residing within the front portion of the cooling chamber are product coils which communicate at their inlets to product source 32 and at their outlets with product conduits 26A–F via trunk line 33 (described herein). The carbonator also communicates at an inlet with $CO_2$ source 31 so that the carbonator may form carbonated water from the water and $CO_2$. Residing behind the product coils is a recirculation coil which connects along with the carbonator to the inlet of carbonated water conduit 27 via trunk line 33. A T-shaped connection allows both the carbonator and the outlet of the recirculation coil to be connected to carbonated water conduit 27. The inlet of the recirculation coil also connects to the outlet of carbonated water conduit 27 via trunk line 33. The ice bank formed by the refrigeration unit serves to exchange heat between the water carried in the water line, the product carried in the product coils and the recirculated carbonated water contained in the recirculation coil.

Thus, in operation, modular dispensing tower 10 is first connected to the product coils, carbonator, and recirculation coil utilizing trunk line 33. Trunk line 33 is an insulated tube which has a plurality of conduits running through it. In the configuration of FIG. 6, trunk line 33 is placed through a hole (not shown) in the countertop and connected to modular dispensing tower 10. Each of product conduits 26A–F and the inlet and outlet of carbonated water conduit 27 is connected to an individual conduit housed within trunk 33 (in the preferred embodiment it is twenty-five feet). Connection between the conduits is made by forcing the conduits contained within trunk line 33 over the barbs at the end of the conduits housed within manifold 14, crimping the trunk conduits down, and securing them using a clamp. The correct and corresponding trunk conduit is then connected to one side of the T-connection between the outlet of the recirculation coil and the carbonator, the inlet of the recirculation coil, and the product lines using the exact same procedure as above. In the above configuration, back cover 12 is connected to housing 11 for aesthetic purposes, and modular dispensing tower 10 merely resides on top of the counter.

In the configuration shown in FIG. 7, modular dispensing tower 10 is connected to the edge of the counter using bracket 24 described above in reference to FIG. 2. Modular dispensing tower 10 is positioned on the edge of the counter such that the counter edge abuts back wall 20, and the portion of housing 11 which extends over back wall 20 resides upon the top of the counter. Fastening screws 25 and 26 are then tighten firmly against the bottom of the counter, thereby, securing modular dispensing tower 10 to the front of the counter. In this configuration, trunk line 33 is connected to modular dispensing tower 10 exactly the same, except that it is positioned in front of the countertop.

In operation, product from product source 32 is pumped through the product coils residing within the water bath to cool the product before it is pumped to dispensing valves 15A–E where it is dispensed upon demand. Water is pumped from the water source through the water lines where it is initially cooled before entering the carbonator. Additionally, $CO_2$ is delivered under pressure from $CO_2$ source 31 to the carbonator. The carbonator places the $CO_2$ in solution to form carbonated water which is then pumped to dispensing valves 15A–E where it is also dispensed with the product on demand. However, during periods of low use, carbonated water is not pumped from the carbonator, and the carbonated water already in the carbonated water lines is pumped continuously through carbonated water conduit 27 to the recirculation coil and then back the carbonated water conduit 27 via its connection by trunk line 33. Thus, the carbonated water continuously exchanges heat with the ice bank such that when it is pumped back to carbonated water conduit 27 it is extremely cold and, therefore, exchanges heat with the product just sitting within product conduits 26A–F. During period of peak use, however, the carbonator will pump sufficient carbonated water to carbonated water conduit 27 to ensure proper carbonated water to product ratio.

The first embodiment of the present invention, therefore, is configured to largely reside in an out of the way place such as under a counter while still dispensing cold drinks. Additionally, the modular dispensing tower by comprising an insulated manifold which allows constant heat exchange in a recirculation system produces drinks, especially the "casual" drink at a temperature far below that of conventional dispensers. Specifically, the present invention will dispense a "casual" drink at or below a temperature of 38° F.

Figure 8:
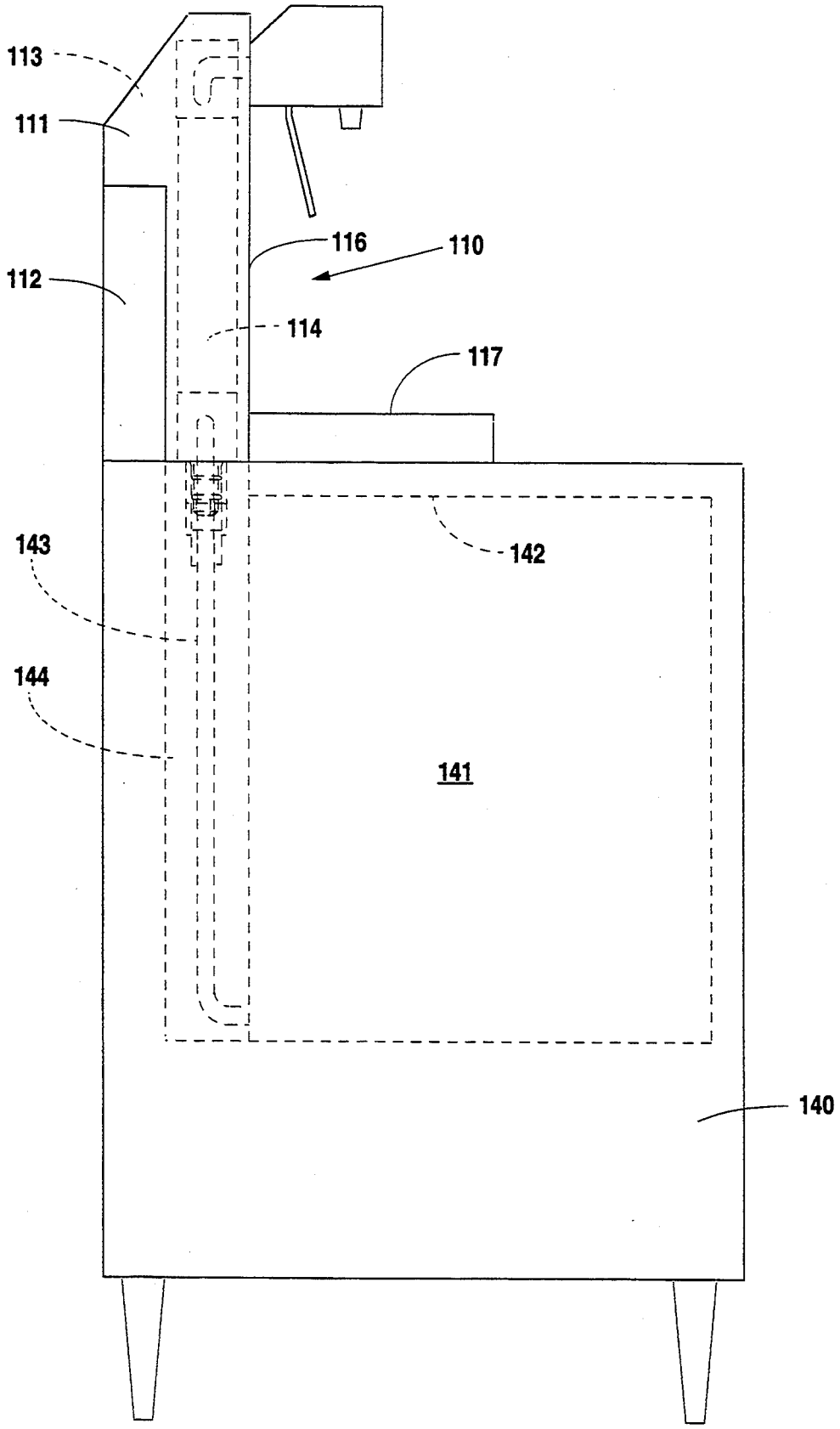
FIG. 8 is a side view showing the modular dispensing tower mounted on a cooling unit housing to form the beverage dispensing apparatus according to the second embodiment of the present invention.
Figure 9:
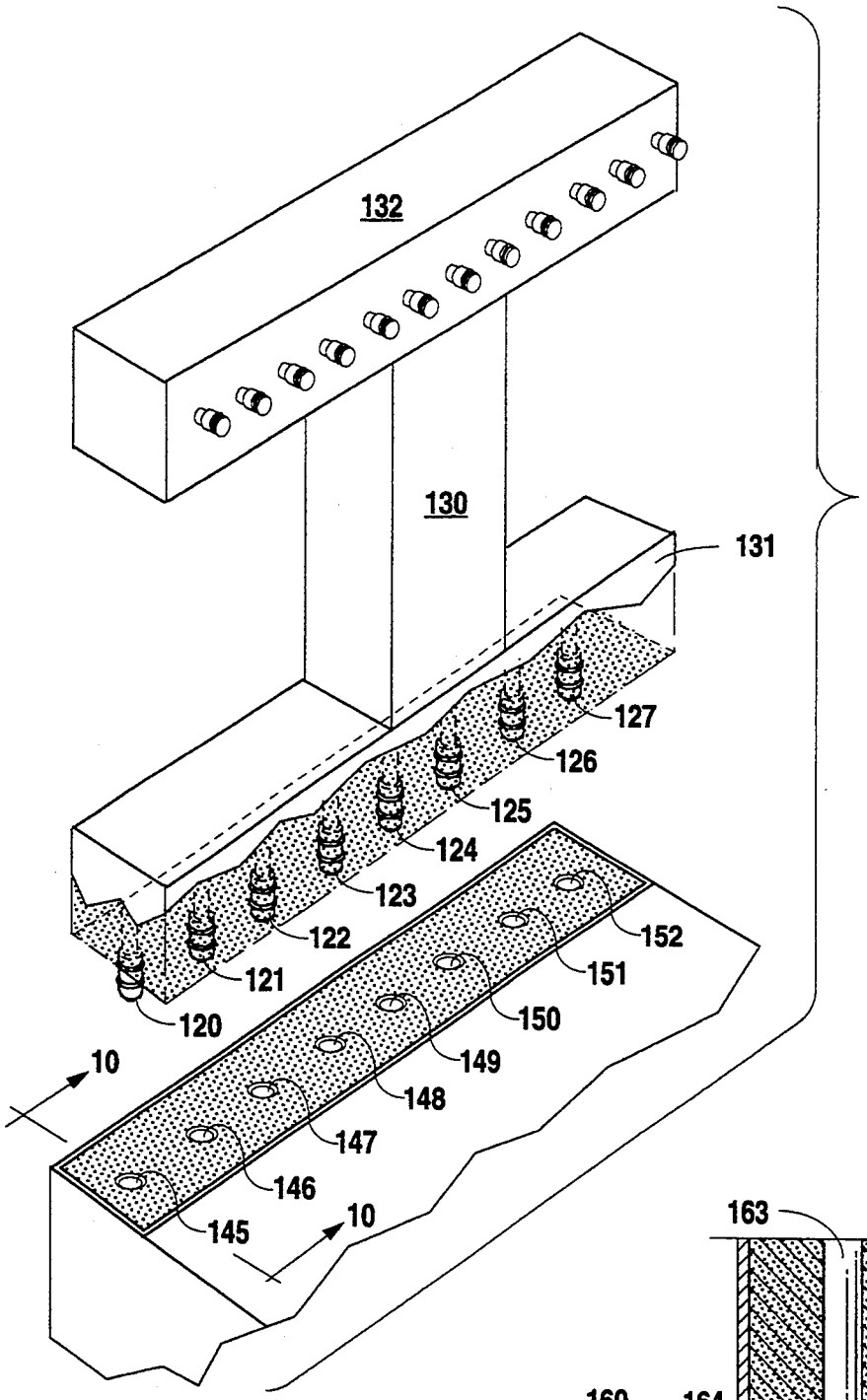
FIG. 9 is a perspective view showing the second embodiment of the manifold of the modular dispensing tower which includes the quick connect couplings and the opposite members placed within the cooling unit housing.
Figure 10:
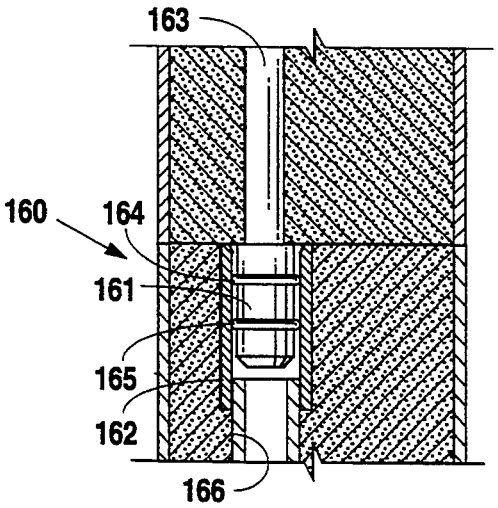
FIG. 10 is a partial cut-away side view showing the mounting of the modular dispensing tower onto the cooling unit housing and the connection of the quick connect couplings.

Referring to FIGS. 8–10, the second embodiment of the beverage dispensing apparatus of the present invention will be described. As shown in FIG. 8, modular dispensing tower 110 is similar to modular dispensing tower 10 of the first embodiment and includes an identical housing 111, rear cover 112, top cover 113, face plate 116, drip tray 117, and dispensing valves. Manifold 114 is identical to manifold 14, except it includes a footer of insulation which encapsulates the male members of the quick connect couplings utilized to connect manifold 114 with the product lines and carbonator of the cooling unit. Additionally, manifold 114 mounts within housing 111 identically to the mounting of manifold 14 within housing 11 of the first embodiment of the modular dispensing tower.

Referring specifically to FIG. 9, manifold 114 includes six product conduits and carbonated water conduit, all of which are encapsulated in an insulating material such as foam. The configuration of the product conduits and the carbonated water conduit within the insulating material of manifold 114 is identical to that of manifold 14 as described with reference to FIGS. 3–5. That is, the carbonated water line encircles the product lines to allow heat transfer from the product within the product lines to the carbonated water within the carbonated water line. Additionally, each outlet of the product conduits and the six outlets from the carbonated water conduit connects to one of the dispensing valves of modular dispensing tower 110 identically to that described for modular dispensing tower 10.

However, the inlets of the product conduits are not bunched together as shown in FIG. 3. Rather, the product conduits fan out from stem 130 to provide a row of inlets that terminate in the male members 121–126 of the quick connect couplings. Carbonated water conduit 27 also fans out from stem 130 into an inlet which terminates at male member 120 of the quick connect couplings and an outlet which terminates at male member 127 of the quick connect couplings. Additionally, manifold 114 includes footer 131 formed integrally with stem 130 to encapsulate the fanned out product conduits and carbonated water conduit. However, male members 120–127 of the quick connect couplings are not encapsulated and, thus, protrude from footer 131. Similarly, manifold 114 includes head 132 formed integrally with stem 130 to encapsulate the product conduits and the carbonated water conduit.

The carbonated water conduit delivers carbonated water to the dispensing valves of modular dispensing tower 114 through six of the outlets protruding from head 132. However, unlike the product lines, the carbonated water conduit does not terminate at the outlets 28A–F, but, instead, it circles around to form a return line which terminates at male member 127 of a quick connect couplings as previously described. The return line portion of the carbonated water conduit connects to the input of a recirculation unit housed within a cooling chamber to permit the recirculation of the carbonated water, thus, providing increased and constant cooling of the carbonated water. The inlet of the carbonated water conduit is not only connected to a carbonator through a carbonated water line but also to the outlet of the recirculation unit. The carbonator and the outlet of the recirculation unit are connected to the carbonated water line through a T-shaped connection. Thus, the constant recirculation of the carbonated water helps to decrease the temperature at which the "casual" drink is dispensed similar to that described in the first embodiment.

Again referring to FIG. 8, cooling unit housing 140 includes cooling chamber 141 and cooling chamber cover 142. Cooling chamber 141 and cooling chamber cover 142 function together to house a refrigeration unit (not shown) and a recirculation unit (not shown) and, further, a water line (not shown), product lines (not shown), and a carbonator (not shown). The refrigeration unit forms an ice bank from a cooling fluid, typically water, contained within cooling chamber 141. The ice bank provides the cooling required by the recirculation line of the recirculation unit, the water line, and the product lines.

Alternatively, cooling chamber 141 and cooling chamber cover 142 function together to house a cold plate which serves as the refrigeration unit and a recirculation unit described above. The cold plate houses a water line (not shown), product lines (not shown), and a carbonated water line (not shown). Ice placed within cooling chamber 141 provides the cooling required by the cold plate.

The cooling unit housing further includes six product conduits, a carbonated water feed conduit, and a carbonated water return conduit. These conduits are shown in outline in FIG. 8 and denoted generally with numeral 143. The cooling unit conduits are encapsulated in an insulation material such as foam to form manifold 144. The insulation material prevents heat exchange between the outside environment and the product and carbonated water circulated through the conduits. Manifold 144 mounts within cooling chamber housing 140 using any suitable means such as screws. The inlets of each of the product conduits, the carbonated water feed conduit, and the carbonated water return conduit reside within cooling chamber 141. The outlets of the product conduits terminate in one of the female members 146–151 of the quick connect couplings (see FIG. 9). To utilize the cold plate, the inlets of each of the product conduits, the carbonated water feed conduit, and the carbonated water return conduit connect to the product lines and a carbonated water line, respectively, of the cold plate.

Additionally, the carbonated water feed conduit terminates in female member 145 of the quick connect couplings, while the carbonated water return conduit terminates in female member 152 of the quick connect couplings. Female members 145–152 of the quick connect valves are encapsulated in the insulating material, however, their openings are left uncovered. Furthermore, although manifold 144 resides within cooling chamber housing 141, both the top of the insulating material and female members 145–152 are exposed as shown in FIG. 9 to allow modular dispensing tower 110 to be mounted onto cooling chamber 141 and connected to the product lines and carbonated water lines.

Each of the product lines within cooling chamber 141 communicates at its inlet with a product source and at its outlet with one of the product conduits mounted within cooling chamber housing using any suitable means such as a clamp or a threaded fitting. The water line connects at its inlet to a water source and at its outlet to the carbonator using any suitable means such as a clamp or a fitting. The carbonator further connects to a $CO_2$ source using any suitable means such as a threaded fitting or a clamp and inlets both water and $CO_2$ to form carbonated water. The outlet of the carbonator connects to the carbonated water line using any suitable means such as a clamp or threaded fitting, while the outlet of the carbonated water line connects to the inlet of the carbonated water feed conduit using any suitable means such as a clamp or threaded fitting.

The recirculation unit comprises a recirculation coil (not shown) positioned within cooling chamber 141 and connected at its outlet using a tee connection to the carbonated water line. The inlet of the recirculation coil connects to the carbonated water return conduit using any suitable means such as a threaded fitting or a clamp. Thus, when modular dispensing tower 110 is mounted onto cooling chamber housing 140, the carbonated water continually circulates from modular dispensing tower 110 through the recirculation coil and back to modular dispensing tower 114 if the dispensing valves are not actuated. The recirculation unit further comprises a pump (not shown) interposed to modular dispensing tower 110 and the recirculation coil to continually pump the carbonated water through the recirculation coil when the dispensing valves are not actuated. Additionally, when the dispensing valves are actuated, carbonated water from the carbonator will be introduced into modular dispensing tower 110 so that sufficient carbonated water to form a dispensed carbonated beverage will always be present.

Referring to FIG. 10, the quick connect couplings will be described. Quick connect coupling 160 comprises male member 161 and female member 162. Male member 161 connects to conduit 163 using any suitable means such as welding and comprises a hollow circularly shaped fitting. The fitting includes two grooves about its outer surface into which 0-rings 164 and 165 are seated, respectively. O-rings 164 and 165 provide a fluid seal which prevents either the product or carbonated water from leaking from quick connect coupling 160 when male member 161 resides within female member 162. Female member 162 comprises a circular tube connected to conduit 166 using any suitable means such as welding. Thus, to engage quick connect coupling 160, male member 161 is inserted into female member 162 with O-rings 164 and 165 providing the fluid seal between male member 161 and female member 162.

To mount modular dispensing tower 110 onto cooling unit housing 140, modular dispensing tower 110 is first positioned over manifold 144 (see FIG. 9). Modular dispensing tower 10 is then lowered onto manifold 144 with each of male members 120–127 lining up with its corresponding female member 145–152. Each of male members 120–127 is forced into its corresponding female member 145–152 until modular dispensing tower 110 sits squarely on cooling chamber housing 140 (see FIG. 8). At that point, a fluid-tight seal exists between each of male members 120–127 and female members 145–152. Additionally, the bottom of footer 131 of manifold 114 rests squarely on the top of manifold 144 to completely insulate the quick connects couplings from the environment (see FIG. 10). With modular dispensing tower 110 mounted onto cooling unit housing 140, product and carbonated water can flow from the product source and carbonator, respectively, to the dispensing valves mounted onto the modular dispensing tower to provide a user with a carbonated beverage.

Figure 11:
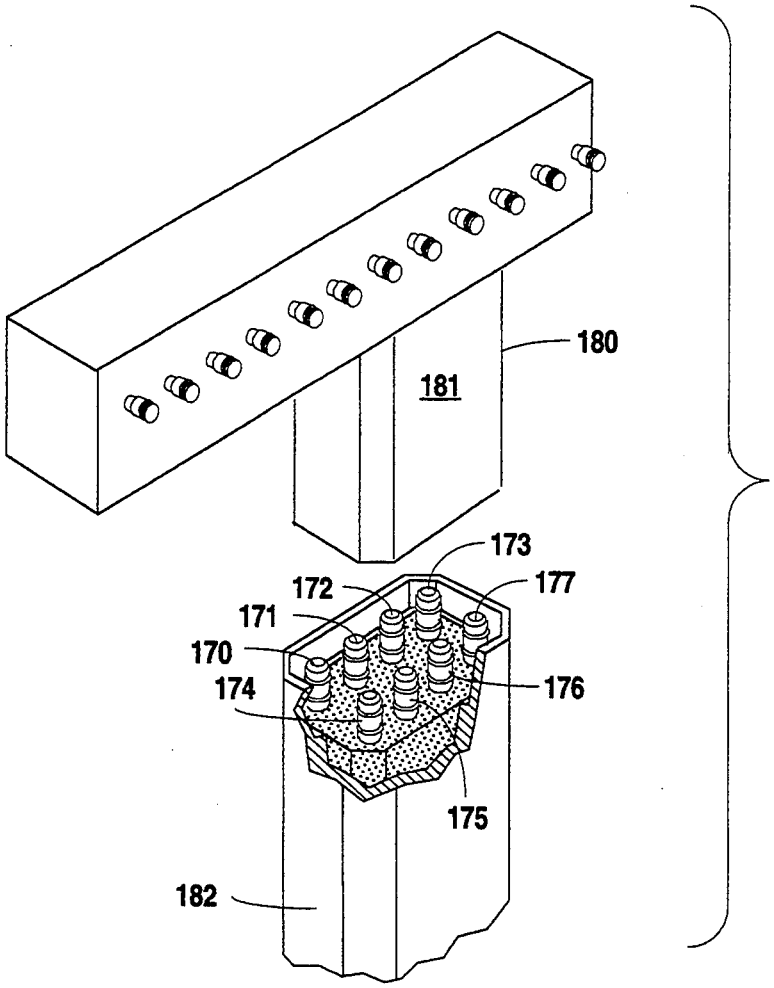
FIG. 11 is a perspective view showing an alternative configuration for the quick connect couplings of the manifold and cooling unit housing.
Figure 12:
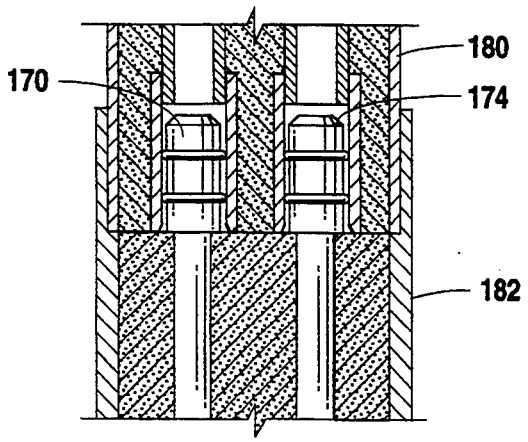
FIG. 12 is a partial cut-away side view showing the mounting of the modular dispensing tower onto the cooling unit housing and the alternative connection configuration of the quick connect couplings.

Referring to FIGS. 11 and 12, an alternative configuration for the quick connect couplings of the second embodiment will be described. Although not shown, the conduits within manifold 180 are configured exactly the same as the conduits of manifold 14 described herein with reference to FIGS. 3–5. Furthermore, manifold 180 resides within a housing to form a modular dispensing tower which is exactly the same as that described with reference to FIGS. 1–3 in the first embodiment.

In this alternative configuration, the product conduits, carbonated water feed conduit, and carbonated water return conduit of the cooling unit housing terminate at their outlets with male members 170–177 of the quick connect couplings, while the inlets of the product conduits and both the inlet and outlet of the carbonated water line within manifold 180 terminate in the female members of the quick connect couplings. Additionally, the product conduits and the carbonated water conduit within manifold 180 do not fan out into a single row as in manifold 114, but, instead, the product conduits and the carbonated water conduit fan out into two rows. Thus, footer 131 of manifold 114 is unnecessary for manifold 180 because stem 181 of manifold 180 adequately surrounds the female members of the quick connect couplings.

To the mount modular dispensing tower which includes manifold 180 onto a cooling unit housing, the modular dispensing tower is first positioned over manifold 182 (see FIG. 11). The modular dispensing tower is then lowered onto manifold 182 with each of male members 170–177 lining up with its corresponding female member. Each of male members 170–177 is forced into its corresponding female member until the modular dispensing tower sits squarely on the cooling chamber housing. At that point, a fluid-tight seal exists between each of male members 170–177 and its corresponding female member. Additionally, a portion of stem 181 of manifold 180 rests within manifold 182 with the bottom of stem 181 resting squarely on the top of manifold 182 to completely insulate the quick connects couplings from the environment (see FIG. 12). With the modular dispensing tower mounted onto the cooling unit housing, product and carbonated water can flow from the product source and carbonator to the dispensing valves mounted onto the modular dispensing tower to provide a user with a carbonated beverage.

From the foregoing description and illustration of this invention, it is apparent that various modifications can be made by reconfigurations or combinations to produce similar results. It is, therefore, the desire of the Applicant not to be bound by the description of this invention as contained in this specification, but to be bound only by the claims as appended hereto.

We claim:

1. A beverage dispensing apparatus, comprising:

a housing;

cooling means disposed within said housing for cooling a beverage delivered from a beverage source;

a first set of conduits connected to said cooling means for receiving the cooled beverage said conduits including outlets that each terminate in first members of a quick connect coupling;

a second set of conduits including inlets that each terminate in second members of said quick connect coupling;

a dispensing tower including an insulating material encapsulating said second set of conduits; wherein said insulating material orients said second set of conduits in said dispensing tower such that said first and second members of said quick connect coupling engage to facilitate the removable mounting of said dispensing tower onto said housing; and dispensing valves mounted on said dispensing tower and communicating with the outlets of said second set of conduits to dispense said beverage delivered from said cooling means.

2. The beverage dispensing apparatus according to claim 1 wherein said second members of said quick connect coupling each comprise a hollow tubular fitting mounted to the inlet ends of said second set of conduits wherein said hollow tubular fittings include a groove for receiving an 0-ring that provides a fluid seal.

3. The beverage dispensing apparatus according to claim 2 wherein said first members of said quick connect coupling each comprise a hollow cylinder mounted to the outlet ends of said first set of conduits for receiving said hollow tubular fitting of said second member to form a fluid seal therebetween.

4. The beverage dispensing apparatus according to claim 1 wherein said first set of conduits is encapsulated within an insulating material to form a manifold that mounts within said housing.

5. The beverage dispensing apparatus according to claim 1 wherein said cooling means comprises a refrigeration unit that exchanges heat from beverages in beverage conduits disposed in said housing.

6. The beverage dispensing apparatus according to claim 1 wherein said first members of said quick connect coupling each comprise a hollow tubular fitting mounted to the outlet ends of said first set of conduits wherein said hollow tubular fittings include groove for receiving an 0-ring that provides a fluid seal.

7. The beverage dispensing apparatus according to claim 6 wherein said second members of said quick connect coupling each comprise a hollow cylinder mounted to the inlet ends of said second set of conduits for receiving said hollow tubular fitting of said first member to form a fluid seal therebetween.

8. The beverage dispensing apparatus according to claim 1 wherein said cooling means comprises a cold plate.

* * * * *